United States Patent [19]

Glaser, II

[11] 4,354,417

[45] Oct. 19, 1982

[54] TONE CHANGER FOR STRINGED INSTRUMENT

[76] Inventor: Joseph Glaser, II, Rte. 6, Box 240, Leipers Creek Rd., Franklin, Tenn. 37064

[21] Appl. No.: 302,498

[22] Filed: Sep. 16, 1981

[51] Int. Cl.[3] ..... G10D 3/14

[52] U.S. Cl. ..... 84/312 R; 84/313

[58] Field of Search ..... 84/312 R, 312 P, 313

[56] References Cited

U.S. PATENT DOCUMENTS

| | | | |
|---|---|---|---|
| 2,235,718 | 3/1941 | Maffei et al. | 84/312 R |
| 2,453,572 | 11/1948 | Ferrier | 84/312 R X |
| 3,512,443 | 5/1970 | Parson et al. | 84/313 |
| 3,686,993 | 8/1972 | Fender | 84/313 |
| 4,080,864 | 3/1978 | Jackson | 84/312 P |

*Primary Examiner*—Lawrence R. Franklin
*Attorney, Agent, or Firm*—Luedeka, Fitch & Neely

[57] ABSTRACT

The specification discloses a tone changer for a guitar (12) having a multiple pull actuator mechanism (14). One or more of the guitar strings are tightened in response to pulling a lever arm (22) away from the guitar (12), or by pushing the lever arm (30) towards the guitar (12), or by pulling the lever arm (26) upwardly in a rotational plane parallel to the rear side of the guitar (12). Straps (16) and (18) are connected between the lever arms (22) and (26), respectively, and are connected at their other end to the performer for selectively imparting an appropriate force on the lever arms. An extension arm (32) is connected to the lever arm (30) for engaging the performer to push the lever arm inwardly towards the guitar (12).

12 Claims, 7 Drawing Figures

TONE CHANGER FOR STRINGED INSTRUMENT

FIELD OF INVENTION

The present invention relates to the field of tone changers having multiple actuators for selectively varying the tension of a plurality of strings in a stringed instrument.

BACKGROUND OF THE INVENTION

In a stringed instrument it is often desirable to change the tone of sound produced by a vibrating string while the string is vibrating. This effect may be accomplished by sliding fingers or a steel bar down the string or by changing the tension on the string while it is vibrating. In known prior art devices, lever mechanisms have been placed on or in a stringed instrument connected to the strings for facilitating the operation of changing the tension on one or more strings.

For example, U.S. Pat. Nos. 1,864,690 to Guibeaud; 2,201,536 to Harvey; 2,949,806 to Turman; 3,721,150 to Hoffman; and 3,479,917 to Zitnik disclose lever mechanisms mounted on the front face or neck of a guitar or other stringed instrument for varying the tension of the instrument strings. U.S. Pat. Nos. 3,512,443 to Parson, et al., and 3,686,993 to Fender disclose lever mechanisms mounted inside a guitar, usually on the rear side thereof. The Parson and Fender mechanisms have levers designed for attachment to the shoulder strap normally used to support the guitar on a performer's neck. The lever is actuated by forcing the guitar downwardly so that the shoulder strap pulls the lever and tensions at least one guitar string.

These prior devices are generally bulky and inconvenient to operate. The levers mounted on the face or neck of the guitar detract from the appearance of the guitar, and some of the devices require a free hand to operate the levers. Often, a performer will not have a free hand when he desires to change the tone of a particular string.

The shoulder strap operated levers require two or three inches of instrument movement to accomplish less than one-eighth of an inch movement in the instrument string. Because of the bulk of these shoulder strap type devices, they are expensive to manufacture and install in a guitar, and it would require a major butchering of an instrument to retrofit these devices into an existing instrument. Thus, it would be totally impractical to retrofit a valuable guitar or other stringed instrument with these known prior art devices.

Many prior art devices, such as the shoulder strap operated lever mechanisms, are designed to act upon one string or one group of strings and are, thus, limited in their versatility and usefulness. Also, such prior art devices generally do not provide a convenient mechanism for deactivating the entire device when desired so that tone changes are not accidentally created.

SUMMARY OF THE INVENTION

The tone changer of the present invention solves the foregoing and other problems long associated with tone changers. In accordance with the invention, an improvement is provided in a stringed musical instrument that is held adjacent to a performer and has a plurality of tensioned strings that are strummed by the performer to produce music. The improvement includes a first arm pivotally mounted on the instrument for pivotal movement in a first direction between first and second stop positions. A transmission mechanism is connected between the first arm and a first selected string of the instrument for varying the tension of the first selected string in response to movement of the first arm from the first stop position to the second stop position. A second arm is pivotally mounted on the instrument for pivotal movement in a second direction between first and second stop positions, and a second transmission mechanism is connected between the second arm and a second selected string of the instrument for varying the tension in the second selected string in response to movement of the second arm from the first stop position to the second stop position.

The improvement described above may also include an adjustable stop mechanism for engaging at least one of the arms to stop movement of the arm in a selected second stop position. The position of the adjustable stop mechanism is adjustable through an infinity of positions within a predetermined range so that the second stop position is variable through an infinity of positions within a corresponding range.

In accordance with another aspect of the present invention, the improvement described above may include a third arm pivotally mounted on the instrument for pivotal movement in a third direction between first and second stop positions. A third transmission mechanism is connected between the third arm and a third selected string of the instrument for varying the tension in the third selected string in response to movement of the third arm from the first stop position to the second stop position. The first arm is pivotal in a direction away from the instrument as the first arm moves from the first stop position to the second stop position, and the second arm is pivotal in a direction toward the instrument as the second arm moves from the first stop position to the second stop position. The third arm is pivotal in a plane generally parallel to the rear side of the instrument as the third arm moves from the first stop position to the second stop position. A first strap is connected between the first arm and the performer for pulling the first arm from the first stop position to the second stop position in response to movement of the instrument away from the performer. A second strap is connected to the third arm and to the performer at a position above the third arm for pulling the third arm from the first position to the second position in response to movement of the instrument in a downward direction. The second arm is configured to engage the performer so that the second arm may be pushed toward the instrument by urging the second arm against the performer.

In accordance with another aspect of the present invention, a mechanism is provided for varying the tension of strings on a stringed musical instrument having a front side and a rear side with the instrument strings being mounted on the front side of the instrument. The mechanism includes a frame mounted in the instrument adjacent the rear side thereof, and a first lever is pivotally mounted in the frame in an orientation generally perpendicular to the rear side of the instrument and being pivotally movable about the midsection of the first lever between first and second stop positions. The first lever includes an outer end extending through the rear side of the instrument and having an inner end disposed within the interior of the instrument. A second lever substantially identical to the first lever is also pivotally mounted in the frame. A first arm includes a proximate end mounted on the outer end of the first lever and has a distal end disposed adjacent to the rear side of the instrument. The first arm is positioned in the rotational plane of the first lever and extends from the first lever in a direction so that urging the distal end of the first arm away from the rear side of the instrument causes the first lever to pivot from the first stop position to the second stop position. A second arm includes a proximate end mounted on the outer end of the second lever and has a distal end disposed spaced apart from the rear side of the instrument. The second arm is positioned in the rotational plane of the second lever and extends from the second lever in a direction that is 180° opposed to the first direction so that urging the distal end of the second arm toward the instrument causes the second lever to pivot from its first stop position to its second stop position. First and second transmission mechanisms are connected between the inner ends of said first and second levers and first and second selected strings of the instrument, respectively, for varying the tension on said first and second selected strings in response to the movement of the first and second levers, respectively, moving from first stop positions to second stop positions.

The mechanism may further include a floating block disposed in the frame in an orientation generally perpendicular to the rear side of the instrument having an outer end extending through the rear end of the instrument and an inner end disposed within the interior of the instrument. A hinge mounts the floating block to the frame for rotational movement about the hinge in an arc substantially coplanar with the rear side of the instrument between first and second stop positions. A third arm has a proximate end mounted on the outer end of the floating block and extends therefrom in a direction generally parallel to the rear side of the instrument so that the distal end of the third arm is disposed adjacent to and spaced apart from the rear side of the instrument. The floating block is operable to rotate from the first stop position to the second stop position in response to rotation of the distal end of the third arm in an arc coplanar with the rear side of the instrument. A third transmission mechanism is connected between the floating block and a third selected string of the instrument for varying the tension of the third selected string in response to movement of the floating block from its first stop position to its second stop position.

The mechanism may further include an adjustable stop mechanism for engaging at least one of the levers to stop movement thereof in a selected second stop position. The position of the adjustable stop mechanism may be adjusted through an infinity of positions within a predetermined range so that the second stop position is variable through an infinity of positions within a corresponding range. The stop mechanism may be adjusted to stop all movement of at least one of said levers so that the stop mechanism is selectively operable for deactivating at least a portion of the mechanism.

BRIEF DESCRIPTION OF THE DRAWINGS

The present invention may best be understood by reference to the Detailed Description when considered in conjunction with the Drawings in which.

DETAILED DESCRIPTION

Figure 1:
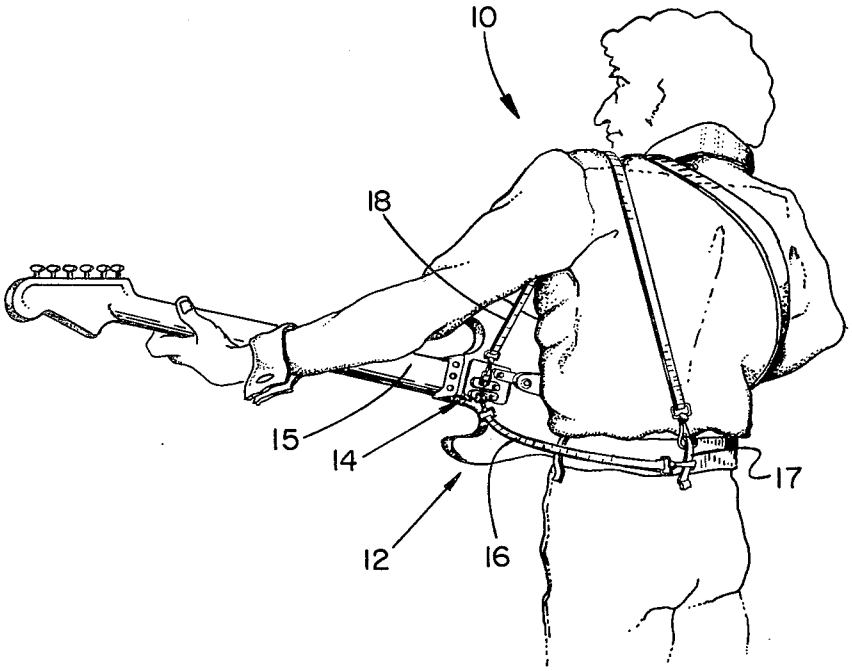
FIG. 1 is a view of a performer playing a guitar incorporating the tone changer of the present invention.

Referring now to the Drawings in which like reference characters designate like or corresponding parts throughout the several views, a performer 10 is shown in FIG. 1 playing a guitar 12 embodying the present invention. An actuator mechanism 14 is mounted on the guitar 12 adjacent to the neck 15 of the guitar. A strap 16 is connected between the actuator mechanism 14 and a rear belt loop 17 on the performer. A second strap 18 is connected to the actuator mechanism 14 and extends over the shoulder of the performer 10 and down to the rear belt loop 17. In this configuration, the performer may vary the tension on three strings or three groups of strings by moving the guitar 12 away from the body of the performer 10, or towards the body of the performer 10 or downwardly with respect to the performer 10.

Figure 2:
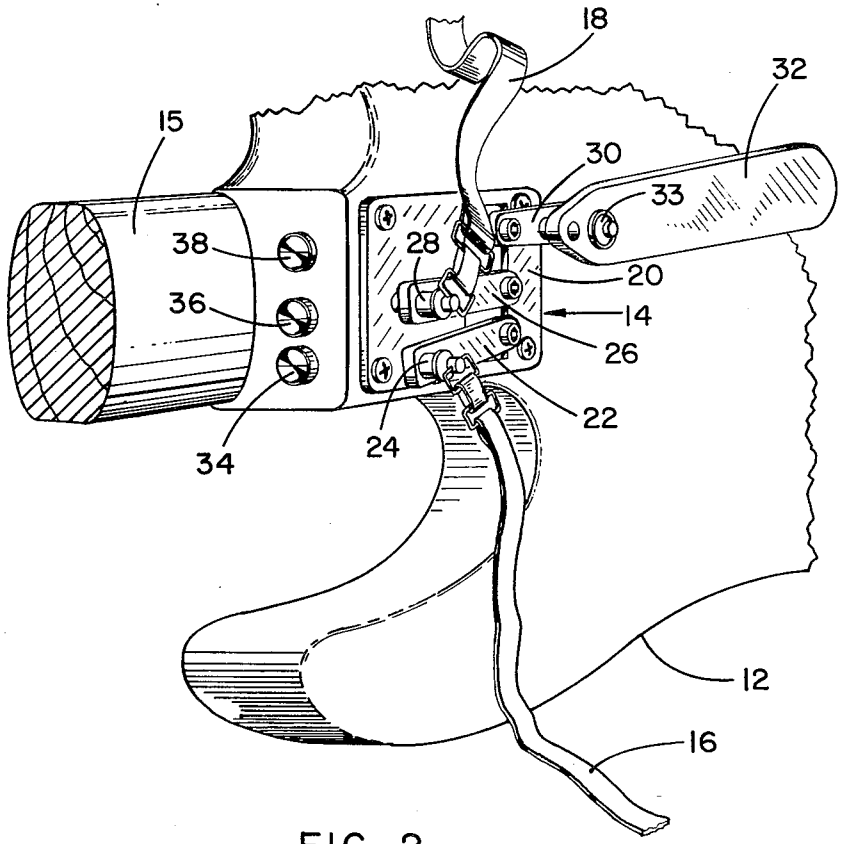
FIG. 2 is a detailed view of the actuator mechanism used in the tone changer to tension guitar strings in response to forces applied to the actuator mechanism.

Referring now to FIG. 2, there is shown a detailed view of the guitar 12 and the actuator mechanism 14. The actuator mechanism 14 includes a face plate 20 mounted on the rear side of the guitar 12. A first lever arm 22 is mounted adjacent the face plate 20 and is positioned substantially parallel thereto. One end of the lever arm 22 is connected by a conventional clip to the strap 16. When the guitar 12 is moved away from the performer's body, the strap 16 is placed in tension and pulls one end of the lever arm 22 outwardly to tighten at least one string of the guitar.

Another lever arm 26 is mounted adjacent the face plate 20 immediately above the lever arm 22. The distal end of the lever arm 26 is connected by a conventional clip 28 to strap 18. When the guitar 12 is forced downwardly with respect to the performer 10, the strap 18 is placed in tension, and the lever arm 26 pivots upwardly. The pivotal movement of the lever arm 26 tightens at least one string of the guitar 12.

A third lever arm 30 is mounted adjacent to face plate 20 immediately above the lever arm 26. The lever arm 30 extends in a direction approximately 180° opposite to the extension direction of the lever arm 22. Also, the lever arm 30 extends outwardly away from the rear side of the guitar 12 so that the distal end of the lever arm 30 is disposed in a spaced apart relationship with the rear side of the guitar 12. An extension arm 32 is connected to one end of the lever arm 30 by a conventional clip 33, and the extension arm 32 is configured to engage the body of the performer 10. When the guitar 12 is forced towards the performer 10, the extension arm 32 engages the performer 10 forcing the lever arm 30 to pivot inwardly towards the guitar 12 to tighten at least one string of the guitar.

Three knobs 34, 36, and 38 are disposed adjacent to the neck 15 of the guitar 12, and are used to adjust stop positions for the three lever arms 22, 26, and 30. The interaction between the knobs 34, 36, and 38 and the actuator mechanism 14 will hereinafter be described in greater detail.

Figure 3:
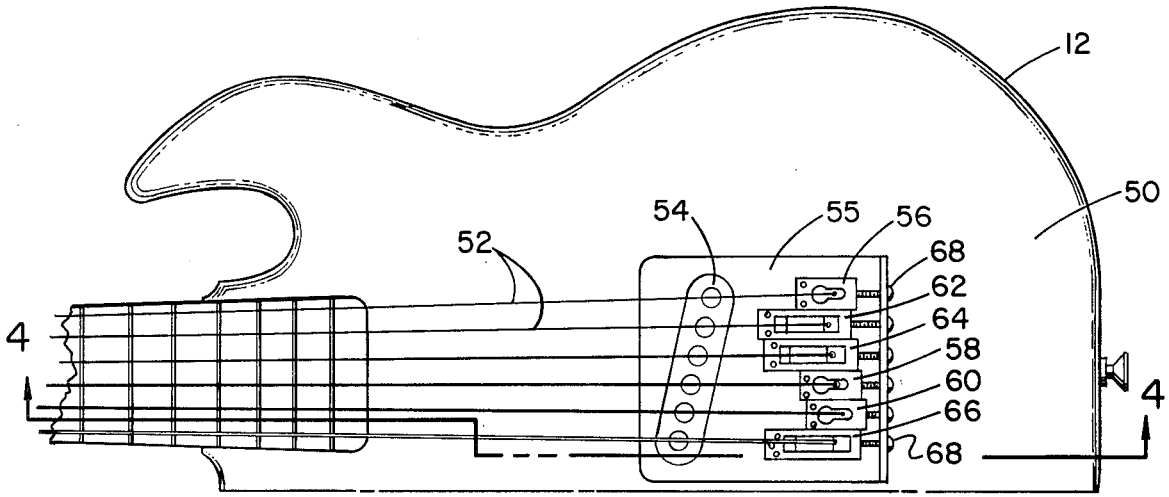
FIG. 3 is a front cut away view of a portion of a guitar incorporating the tone changer of the present invention.

Referring now to FIG. 3, there is shown a front cut away view of a portion of the front side of the guitar 12. Six guitar strings 52 are secured to the front side of the guitar 12, and a standard electrical pickup 54 is mounted adjacent one end of the strings 52. Three of the strings 52 are secured to the guitar 12 by conventional string mounts 56, 58, and 60. The remaining of the strings 52 are secured to the base of the guitar 12 by rocker arm mounts 62, 64, and 66 that may be utilized to tighten or loosen the strings 52 as will be hereinafter described in detail.

Each of the conventional string mounts 56, 58, and 60 and each of the rocker arm mounts 62, 64, and 66 are secured to the front side of the guitar 12 by adjustment screws 68 in a conventional manner so that the position of such string mounts may be adjusted to adjust the lengths of the strings 52.

Figure 4:
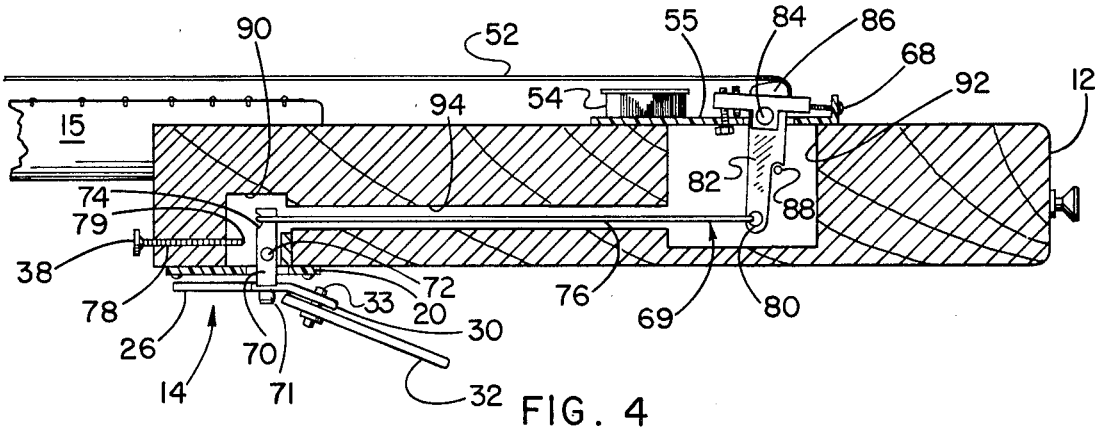
FIG. 4 is a somewhat diagrammatical cross-sectional view of a guitar embodying the tone changer of the present invention.

Referring now to FIG. 4, there is shown a somewhat diagrammatical cross-sectional view of the guitar 12 taken through section line 4—4 shown in FIG. 3. This view illustrates the operation of the actuator mechanism 14 and a transmission 69 for tightening an individual string 52 in response to motion of the actuator mechanism 14.

The actuator mechanism 14 includes a lever 70 having an outer end disposed exterior of and adjacent to the rear side of the guitar 12 with the lever arm 30 mounted thereon by an allen head bolt 71. The lever 70 is mounted on and pivots about an axis 72, and the inner end of the lever 70 includes a notch 74 for securing a cable 76 thereto.

The lever 70 is normally in the position shown in FIG. 4 which is defined as the first stop position. However, when the extension arm 32 is forced inwardly towards the guitar 12, the lever 70 rotates in a counterclockwise direction as shown in FIG. 4 so that the notch 74 on the lever 70 moves toward the neck 15 of the guitar 12 pulling the cable 76. The travel of the lever 70 is limited by a screw 78 whose position is controlled by the knob 38. The screw 78 is threadedly secured in the guitar 12 adjacent to the lever 70. As the lever 70 is pivoted from the first stop position, its travel will be limited by the engagement of the lever 70 and the end 79 of the screw 78. When the lever 70 engages end 79 of the screw 78, it is in a position defined as the second stop position. The position of the end 79, and thus the second stop position may be varied by rotating the screw 78 using the adjustment knob 38. In this manner, the performer may adjust the knob 38 to attain the desired travel of the lever 70, and, thus, to attain the desired tone change. It will be appreciated that the screw 78 could be screwed into the guitar 12 until it engages the lever 70 when it is in the first stop position. In this configuration, the lever 70 will be deactivated or held in the first stop position so that accidentally applying a force to the extension arm 32 will not change the tension of the guitar strings 52.

The cable 76 is attached at its other end to an aperture 80 formed in the lower end of a rocker arm 82. The rocker arm 82 is mounted adjacent the front side of the guitar 12 on an axis 84, and a guitar string 52 is attached to the upper end 86 of the rocker arm 82. As shown in FIG. 4, the rocker arm 82 is in a first stop position, and it is engaging a stop 88. The stop 88 resists the torque imparted on the rocker arm 82 by the guitar strings 52. When the lever 70 moves from the first stop position to the second stop position, a tension force is transmitted through cable 76 to the aperture 80 in the rocker arm 82. This force pulls the lower end of the rocker arm toward the lever 70 and because of the rotation about axis 84, the upper end 86 of the rocker arm 82 moves away from the guitar strings 52, thus tightening the guitar string attached to the rocker arm 82.

The degree of increased tension in the guitar string attached to rocker arm 82 is determined by the amount of travel of the lever 70. Thus, by adjusting the second stop position using the screw 78, the tone produced by a tightened guitar string may be adjusted.

As shown in FIG. 4, the actuator mechanism 14 and the transmission 69 are mounted in a solid wood guitar 12. In order to accommodate the lever system of the actuator mechanism 14, such as lever 70, a small cavity 90 is formed in the guitar 12 adjacent the neck 15. Another cavity 92 is formed in the guitar 12 below the rocker arm mounts 62, 64, and 66 in order to accommodate the rocker arm 82 and the travel of such rocker arm. A small groove or channel 94 is bored between cavity 90 and cavity 92 to accommodate cables, such as cable 76 extending between the two cavities.

Figure 5:
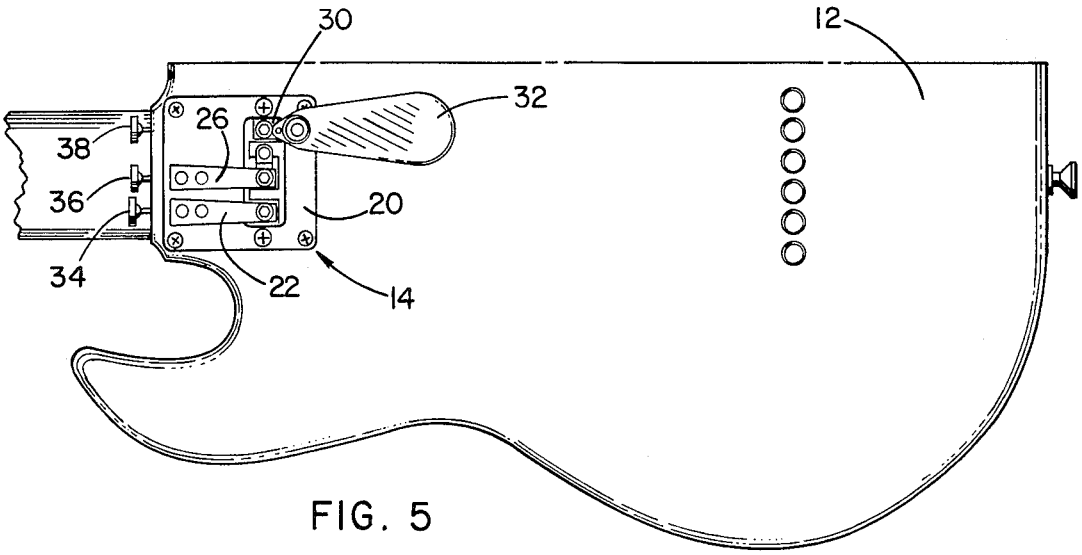
FIG. 5 is a rear view of a portion of a guitar showing the actuator mechanism of the tone changer.

Referring now to FIGS. 3, 4, and 5, it will be appreciated that the present invention may be incorporated into a guitar 12 with a minimum of modification or "butchering" of the guitar. For example, the cavity 90 has a volume of approximately two cubic inches, and the cavity 92 has a volume of approximately four cubic inches. The channels 94 extending between the two cavities need only be large enough to accommodate the diameter of a cable such as cable 76. Such channels 94 are normally less than an eighth of an inch. Except for the appearance of the rocker arm mounts 62, 64, and 66, the appearance of the front of the guitar 12 is not effected by the installation of the actuator mechanism 14 or the transmission 69. The appearance of the rear side of the guitar 12 as shown in FIG. 5 is modified only by the appearance of the actuator mechanism 14 and the knobs 34, 36, and 38. To return the guitar 12 back to its approximate original appearance, the knobs 34, 36, and 38 and the actuator mechanism 14 may be removed from the guitar, and the face plate 20 would be replaced by an unobtrusive plate covering the cavity 90.

Figure 6:
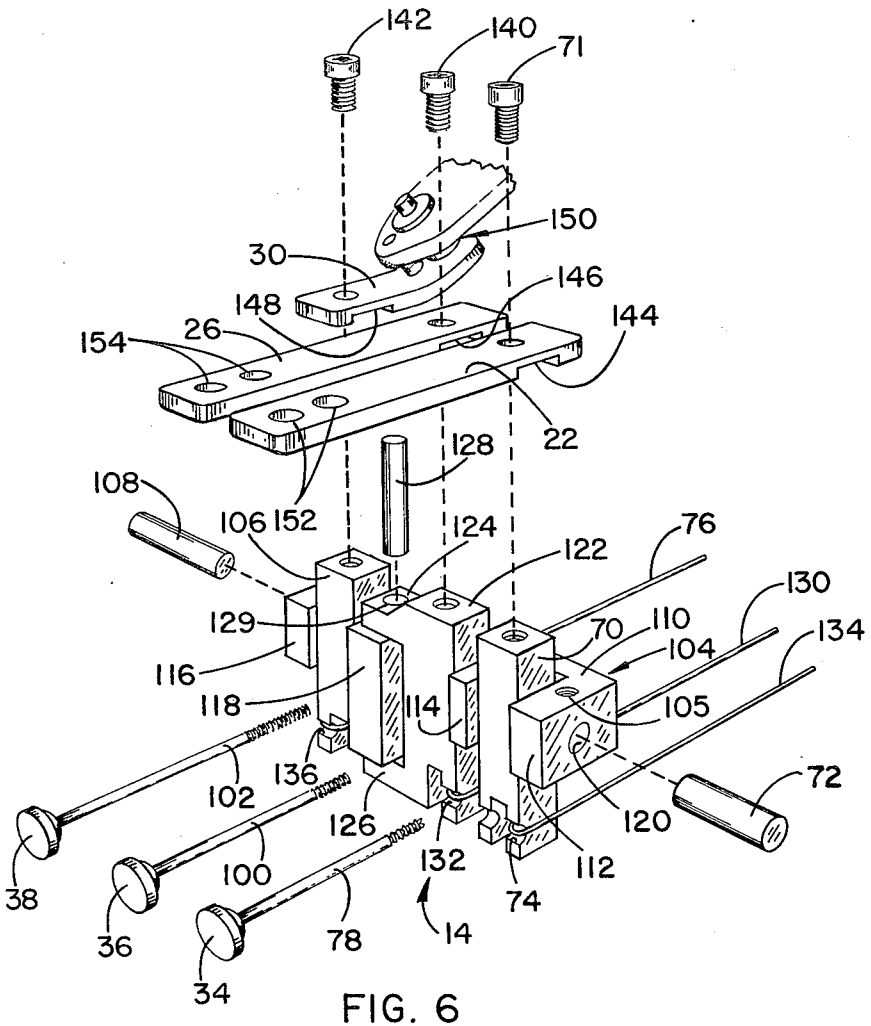
FIG. 6 is an exploded detail view of the actuator mechanism of the tone changer.

Referring now to FIG. 6, there is shown an exploded view of the actuator mechanism 14. In FIG. 6, the actuator mechanism 14 is oriented as if the viewer was looking at the rear side of the guitar 12. Adjustment screws 78, 100, and 102 are shown in their approximate position as they would appear mounted in the guitar 12, except that screws 78 and 100 have been cut away for purposes of clarity of illustration.

The actuator mechanism 14 includes a main frame 104 in which the levers, such as lever 70 are mounted. The main frame 104 is mounted on the underside of the plate 20, as shown in FIGS. 4 and 5, by screws secured in threaded bores in the main frame 104, such as the threaded bore 105. Frame 104 includes a main beam 110 and three transverse beams 112, 114, and 116 extending perpendicularly therefrom. Also, a mounting block 118 extends from the main beam 110 in a direction generally parallel to and aligned with the transverse beams 112, 114, and 116. An aperture 120 is formed in the transverse beam 112, and corresponding apertures or bores are formed in the lever 70 and the transverse beam 114 for receiving the axis 72. In this manner, the lever 70 is mounted in the frame 104 for pivotal movement about the axis 72. Likewise, the lever 106 is pivotally mounted between the transverse beam 116 and the mounting block 118 by the axis 108 that extends through appropriately dimensioned apertures in the transverse beam 116, the lever 106, and the mounting block 118.

The mounting block 118 has a pair of flanges 124 and 126 extending therefrom that are disposed, respectively, immediately above and below the mounting block 118. An aperture 129 is formed in the flange 124 and corresponding bores or apertures are formed in the mounting block 118 and the flange 126 for receiving a pin 128 to pivotally mount the floating block 122 thereon. In this configuration, the flanges 124 and 126 and the pin 128 form a hinge for mounting the floating block 122 on the mounting block 118. The floating block 122 will rotate about the pin 128 in a rotational direction that is parallel to the rear side of the guitar 12. The levers 70 and 106 rotate in a rotational direction generally perpendicular to the rear side of the guitar 12.

A cable 76 is attached to a notch 74 on the lower end of the lever 70. Likewise, a cable 130 is attached to a notch 132 formed in the lower end of the floating block 122, and a cable 76 is attached to a notch 136 formed in the lower end of lever 106. There is a constant tension force on the cables 76, 130 and 134 that pulls the levers 106 and 70 and the floating block 122 to a first stop position against the main frame 104. Thus, when not actuated, the lever 70 and 106 and the floating block 122 are pulled against the main frame 104 as shown in FIG. 6. However, when actuated, the lever 70 or 106 or the floating block 122 will rotate against the force applied by the cable 76, 130 or 134 until it engages one of the screws 78, 100 or 102.

The levers 70 and 106 and the floating block 122 are shown in FIG. 6 in a position defined as the first stop position. When the lever 70 or 106 or the floating block 122 rotates to engage the screws 78, 100, or 102, it assumes a position defined as the second stop position.

The lever arms 22, 26, and 30 are secured to the levers by allen head bolts 71, 140, and 142. Grooves 144, 146, and 148 are formed in the proximate ends of the lever arms 22, 26, and 30, respectively, that are dimensioned to snugly receive the outer ends of the lever 70, the floating block 122, and the lever 106, respectively.

The extension arm 32 is secured to the lever arm 30 by a prong and clip mechanism 150 that fits into a pair of apertures in the lever arm 30. A pair of apertures 152 is formed in the distal end of lever arm 22, and a pair of apertures 154 is formed in the distal end of lever arm 26, each for attaching straps and the like to the lever arms.

By reference to FIG. 6, it will be appreciated that pulling the arm 22 away from the actuator mechanism 14 will cause the lever 70 to rotate to its second stop position. Rotating the arm 26 in a plane parallel to the rear side of the guitar 12 (into the page as shown in FIG. 6) will cause the floating block 122 to rotate towards the screw 180 to its second stop position. Forcing the lever arm 30 toward the actuator mechanism 14 will cause the lever 106 to rotate to its second stop position.

Figure 7:
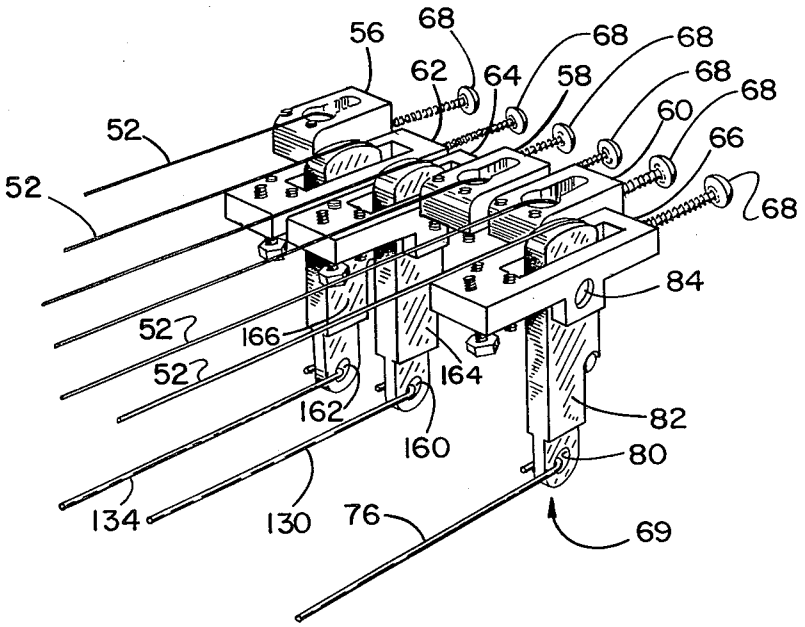
FIG. 7 is a somewhat diagrammatical detail view of the rocker arm and cable system used to interconnect the strings of a guitar with the actuator mechanism of the tone changer.

Referring now to FIG. 7, there is shown an exploded view of the transmission mechanism used to transmit force from the actuator mechanism to the guitar strings 52. The transmission mechanism includes cables 76, 130, and 134 that are connected to apertures 80, 160, and 162, respectively, of rocker arms 82, 164, and 166, respectively. The rocker arms 164 and 166 are identical to the rocker arm 82 and are mounted in rocker arm mounts 62 and 64 that are identical to the mount 66 in which rocker arm 82 is mounted. Each of the rocker arms 82, 164 and 166 are pivotally mounted in the rocker arm mounts 62, 64 and 66 on an axis formed by a screw, such as screw 68 in mount 66. The rocker arm mounts 62, 64, and 66 are attached to a plate on the front side of the guitar by adjustment screws collectively referred to herein as screws 68. The position of the rocker arm mounts 62, 64, and 66, and the conventional guitar string mounts 56, 58, and 60 may be adjusted by rotating the appropriate adjustment screw 68. This adjustment process may be most clearly understood by reference to FIGS. 3 and 4.

Also, by reference to FIGS. 3 and 7, it will be noted that the width of the conventional guitar string mounts 56, 58, and 60 and the width of the rocker arm mounts 62, 64, and 66 are the same so that the rocker arm mounts may be substituted for the conventional mounts, and, thus, the tone changer of the present invention could be modified to vary the tension on any of the guitar strings 52.

The present invention may also be modified so that the actuation of one lever varies the tension in more than one guitar string, for example, a pin, rod, or other connection could be made between apertures 160 and 162 in rocker arms 164 and 166. Then, for example, the cable 134 could be attached to the interconnection between rocker arms 164 and 166 so that tensioning cable 134 will pull both rocker arms 164 and 166, thus, tightening two of the guitar strings 52. It is also contemplated that by using the appropriate conventional transmission mechanism, the actuation of a lever in the actuation mechanism 14 could be translated into a decrease in tension on one or more of the guitar strings.

Although a single embodiment has been described in the foregoing Detailed Description, it will be understood that the invention is capable of numerous rearrangements, modifications, and substitutions of parts without departing from the spirit of the invention.

I claim:

1. In a stringed musical instrument that is held adjacent to a performer and has a plurality of tensioned strings that are strummed by the performer to produce music, the improvement comprising:

a first arm pivotally mounted on said instrument for pivotal movement in a first direction between first and second stop position;

first transmission means connected between said first arm and a first selected string of the instrument for varying the tension in the first selected string in response to movement of said first arm from the first stop position to the second stop position;

a second arm pivotally mounted on the instrument for pivotal movement in a second direction between first and second stop positions; and second transmission means connected between said second arm and a second selected string of the instrument for varying the tension in the second selected string in response to movement of said second arm from the first stop position to the second stop position.

2. The improvement of claim 1 further comprising an adjustable stop mechanism for engaging at least one of said arms to stop movement of said arm in a selected second stop position, the position of said adjustable stop mechanism being adjustable through an infinity of positions within a predetermined range so that the second stop position is variable through an infinity of positions within a corresponding range.

3. The improvement of claim 1 further comprising a third arm pivotally mounted on said instrument for pivotal movement in a third direction between first and second stop positions; and a third transmission means connected between said third arm and a third selected string of the instrument for varying the tension in the third selected string in response to movement of said third arm from the first stop position to the second stop position.

4. The improvement of claim 1 wherein:

said first arm is pivotal in a direction away from said instrument as said first arm moves from the first stop position to the second stop position of said first arm; and said second arm is pivotal in a direction toward the instrument as said second arm moves from the first stop position to the second stop position of said second arm.

5. The improvement of claim 4 further comprising:

a strap for being connected between said first arm and the performer, so that said first arm is movable from the first stop position to the second stop position in response to movement of the instrument away from the performer to place tension on said strap and pull said first arm; and an extension mounted on said second arm and extending away from the instrument for engaging the performer, so that said second arm is movable from the first stop position to the second stop position of said second arm in response to movement of the instrument toward and against the performer to push said second arm.

6. In a stringed instrument that is held in the arms of a performer and includes a plurality of tensioned strings that are struck by the performer to produce music, the improvement comprising:

a first arm pivotally mounted on the instrument adjacent the performer for pivotal movement between first and second stop positions, said first arm being pivotally movable in a direction away from the instrument as said first arm moves from the first stop position to the second stop position of said first arm;

first transmission means connected between said first arm and a first selected string of the instrument for varying the tension in the first selected string in response to movement of said first arm from the first stop position to the second stop position of said first arm;

a second arm pivotally mounted on the instrument adjacent the performer for pivotal movement toward the instrument between first and second stop positions, said second arm being configured to engage the performer so that said second arm may be pushed toward the instrument by urging said second arm against the performer;

second transmission means connected between said second arm and a second selected string of the instrument for varying the tension in the second selected string in response to movement of said second arm from the first stop position to the second stop position of said second arm;

a third arm pivotally mounted on the instrument adjacent the performer for pivotal movement between first and second stop positions, said third arm being movable in an upward direction as said third arm moves from the first stop position to the second stop position of said third arm;

third transmission means connected between said third arm and a third selected string of the instrument for varying the tension in the third selected string in response to movement of said third arm from the first stop position to the second stop position of said third arm;

a first strap connected between said first arm and the performer for pulling said first arm from the first stop position to the second stop position in response to movement of the instrument away from the performer; and a second strap connected to said third arm and to said performer at a position above said third arm for pulling said third arm from the first stop position to the second stop position in response to movement of the instrument in a downward direction.

7. A mechanism for varying the tension of strings on a stringed musical instrument having a front side and a rear side with the instrument strings being mounted on the front side of the instrument, comprising:

a frame mounted in the instrument adjacent the rear side thereof;

a first lever pivotally mounted in said frame in an orientation generally perpendicular to the rear side of the instrument and being pivotally movable about the midsection of said first lever between first and second stop positions, said first lever having an outer end extending through the rear side of the instrument and having an inner end disposed within the interior of the instrument;

a second lever pivotally mounted in said frame in an orientation generally perpendicular to the rear side of the instrument and being pivotally movable about the midsection of said second lever between first and second stop positions, said second lever having an outer end extending through the rear side of the instrument and having an inner end disposed within the interior of the instrument;

a first arm having a proximate end mounted on the outer end of said first lever and having a distal end disposed adjacent to the rear side of said instrument, said first arm being positioned in the rotational plane of said first lever and extending from said first lever in a first direction so that urging the distal end of said first arm away from the rear side of the instrument causes said first lever to pivot from the first stop position to the second stop position;

a second arm having a proximate end mounted on the outer end of said second lever and having a distal end disposed spaced apart from the rear side of said instrument, said second arm being positioned in the rotational plane of said second lever and extending from said second lever in a second direction that is 180° opposed to said first direction so that urging the distal end of said second arm toward the instrument causes said second lever to pivot from its first stop position to its second stop position;

first transmission means connected between the inner end of said first lever and a first selected string of said instrument for varying the tension on said first selected string in response to said first lever moving from its first stop position to its second stop position; and second transmission means connected between the inner end of said second lever and a second selected string of said instrument for varying the tension on the second selected string in response to said second lever moving from its first stop position to its second stop position.

8. The mechanism of claim 7 wherein said first transmission means comprises:

a first rocker arm mounted in the instrument having an outer end extending from the front side of the instrument and having an inner end disposed within the instrument with at least one instrument string being secured to the outer end of said first rocker arm;

a pivot means for pivotally securing the midsection of said first rocker arm on the instrument for pivotal movement within a selected rotational range;

stop means for limiting the pivotal movement of said first rocker arm in one direction to resist the torque on said first rocker arm caused by the tension of the string secured to the outer end of said rocker arm; and a cable attached between the inner end of said first rocker arm and the inner end of said first lever for transmitting a tension force therebetween.

9. The mechanism of claim 7 further comprising:

a floating block disposed in said frame in an orientation generally perpendicular to the rear side of said instrument and having an outer end extending through the rear side of said instrument and an inner end disposed within the interior of the instrument;

hinge means for mounting said floating block to said frame for rotational movement about said hinge means in an arc substantially coplanar with the rear side of the instrument between first and second stop positions;

a third arm having a proximate end and a distal end, the proximate end being mounted on the outer end of said floating block with said third arm extending therefrom in a direction generally parallel to the rear side of said instrument so that the distal end of said third arm is disposed adjacent to and spaced apart from the rear side of said instrument;

said floating block being operable to rotate from the first stop position to the second stop position of said floating block in response to rotation of the distal end of said third arm in an arc coplanar with the rear side of said instrument; and third transmission means connected between said floating block and a third selected string of the instrument for varying the tension in the third selected string in response to movement of said floating block from the first stop position to the second stop position of said floating block.

10. The mechanism of claim 9 wherein said third arm extends from said floating block in a generally horizontal direction so that upward movement of the distal end of said third arm causes said floating block to rotate about said hinge means from the first stop position to the second stop position of said floating block.

11. The mechanism of claim 7 further comprising an adjustable stop mechanism for engaging at least one of said levers to stop movement of said lever in a selected second stop position, the position of said adjustable stop mechanism being adjustable through an infinity of positions within a predetermined range so that the second stop position is variable through an infinity of positions within a corresponding range.

12. The mechanism of claim 11 wherein said adjustable stop mechanism is adjustable to stop all movement of at least one of said levers so that said stop mechanism is selectively operable for deactivating at least a portion of said mechanism.

* * * * *